US005745128A

United States Patent [19]

Lam et al.

[11] Patent Number: 5,745,128

[45] Date of Patent: Apr. 28, 1998

[54] METHOD AND APPARATUS FOR INK TRANSFER PRINTING

[75] Inventors: Si-Ty Lam, Pleasanton; Young-Soo You, Los Altos, both of Calif.

[73] Assignee: Hewlett Packard Company, Palo Alto, Calif.

[21] Appl. No.: 700,629

[22] Filed: Aug. 16, 1996

Related U.S. Application Data

[63] Continuation of Ser. No. 295,180, Aug. 24, 1994, abandoned, which is a continuation of Ser. No. 983,007, Nov. 30, 1992, Pat. No. 5,381,166.

[51] Int. Cl.[6] ..... B41J 2/005

[52] U.S. Cl. ..... 346/140.1

[58] Field of Search ..... 346/140.1

[56] References Cited

U.S. PATENT DOCUMENTS

| | | | |
|---|---|---|---|
| 2,925,312 | 2/1960 | Hollmann | 347/53 |
| 3,553,708 | 1/1971 | Carreira | 347/51 |
| 3,790,703 | 2/1974 | Carley | 347/61 X |
| 4,164,745 | 8/1979 | Cielo et al. | 347/61 |
| 4,263,601 | 4/1981 | Nishimura | 347/91 X |
| 4,275,290 | 6/1981 | Cielo et al. | 347/61 X |
| 4,314,263 | 2/1982 | Carley | 347/55 |
| 4,376,284 | 3/1983 | Bader | 347/40 |
| 4,521,788 | 6/1985 | Kimura | 347/40 |
| 4,550,324 | 10/1985 | Tamaru et al. | 346/140.1 X |
| 4,561,789 | 12/1985 | Saito | 346/140.1 X |
| 4,608,577 | 8/1986 | Hori | 347/91 X |
| 4,660,058 | 4/1987 | Cordery | 347/61 |
| 4,675,694 | 6/1987 | Bupara | 346/140.1 X |
| 4,683,481 | 7/1987 | Johnson | 347/65 |
| 4,785,311 | 11/1988 | Kaneko | 346/140.1 |
| 5,099,256 | 3/1992 | Anderson | 347/103 |
| 5,113,200 | 5/1992 | Deguchi et al. | 347/101 X |
| 5,381,166 | 1/1995 | Lam | 346/140.1 |
| 5,481,280 | 1/1996 | Lam | 346/140.1 |

FOREIGN PATENT DOCUMENTS

| | | | |
|---|---|---|---|
| 0488415A2 | 6/1992 | European Pat. Off. | B41J 2/17 |
| 62-97866 | 5/1987 | Japan | B41J 3/20 |
| 62-218148 | 9/1987 | Japan | B41J 3/20 |
| 63-254067 | 10/1988 | Japan | B41J 3/20 |
| 4-196236 | 4/1992 | Japan . | |

OTHER PUBLICATIONS

Robert C. Dubeck et al., "Output Hardcopy Devices", Academic Press, Inc., 1988, pp. 261–270.

RISO RC5800 Digital Duplicator brochure, RISO, Inc., Danvers, Massachusetts, Jun. 1991.

Hiroyuki Yamaguchi et al, "Study of Recording Characteristics of Thermal Rheography", Non Impact Printing Conference, 1986.

Theodore G. Ducios, "Design of Devices Using Electrorheological Fluids", Society of Automotive Engineers, Future Transportation Technology Conference and Exposition, San Francisco, CA, Aug. 8–11, 1988.

Theodore G. Ducios, "Fluids That Thicken Electrically", Machine Design, Jan. 21, 1988.

Noriaki Kiyohiro et al., "Model of Droplet Ejection in the ElectroRheological Fluid Inkjet", (Abstract).

Noboru Toyama et al, "Novel Printing—Using Polymeric Gel as Ink", SPIE, vol. 1079, Hard Copy Output, 1989.

*Primary Examiner*—Joseph W. Hartary

*Attorney, Agent, or Firm*—Timothy Rex Croll

[57] ABSTRACT

An ink transfer printing device in which ink transfer is driven by a viscosity change in ink. The ink transfer printing device includes an ink reservoir for retaining ink held under pressure. The ink reservoir is associated with an ink transfer surface which has a plurality of perforations. Under ambient conditions, the viscosity of the ink prevents flow of the ink through the perforations. The ink transfer printing device also includes a viscosity control unit for inducing a change in the viscosity of the ink near certain perforations thereby enabling a controlled amount of the ink near each of these certain perforations to flow through these certain perforations to an outer surface of the ink transfer surface. The ink which has flowed onto the outer surface can then be transferred to an intermediate surface or a printing media. A method for viscosity-driven ink transfer printing is also disclosed. The present invention enables a printer, a copier, or the like to provide low cost, high speed, high resolution printed images.

20 Claims, 13 Drawing Sheets

METHOD AND APPARATUS FOR INK TRANSFER PRINTING

CROSS-REFERENCE TO RELATED APPLICATIONS

This application is a continuation of U.S. application Ser. No. 08/295,180, filed Aug. 24, 1994, abandoned which is a continuation of U.S. application Ser. No. 07/983,007, now U.S. Pat. No. 5,381,166, filed Nov. 30, 1992, and commonly assigned with the present invention.

BACKGROUND OF THE INVENTION

1. Field of the Invention

The present invention relates to the field of ink transfer printing and, more particularly, to ink transfer printing which is driven by a viscosity change in ink.

2. Description of the Related Art

Over the years, many attempts have been made to develop a printing technique with a simple mechanical structure. The hope being that such a printing technique would lead to reliable, low cost products. For one reason or another, known printing techniques have not been able to fully satisfy these goals.

Known thermal printing techniques have certain drawbacks. Direct thermal printing, for example, requires special heat sensitive paper. Thermal transfer printing inefficiently uses ink ribbons, which leads to higher cost for ribbon usage, especially for color printing. Another disadvantage of thermal printers is that their printing speed is too slow for large volume printing.

Ink jet printing has many advantages, but continues to have some reliability concerns. A major disadvantage of ink jets, namely bubble-type ink jet devices, is that deposits form in the nozzles when the organic compounds in the ink break down at high temperatures (e.g., 350° C.). The high temperatures are needed to produce the bubbles which cause a drop to be ejected. As a result, the bubble-type ink jets tend to have a clogging or crusting problem at the nozzles. Another disadvantage of ink jets is that the ink used must have a low viscosity (e.g., typically <10 centipoise) which severely limits the type and variety of inks which may be used. The printing speed of ink jets is also too slow for large volume printing.

Additional background information on known printing techniques may be found in "Computer Graphics—Technology and Applications," Vol. II—"Output Hardcopy Devices," by Robert C. Durbeck and Sol Sherr, San Diego 1988.

In Hori, U.S. Pat. No. 4,608,577, an ink jet type thermal printing machine is described. The printing machine includes a film or belt having a plurality of holes which correspond to the conventional ink jet nozzle. The holes in the film or belt are filled with ink. The ink in the holes is then heated (vaporized) until bubble pressure causes the ink to be jetted out onto paper.

In Bupara, U.S. Pat. No. 4,675,694, a printer is described. The printer includes a perforated printing plate, individual heaters, and an ink container. The ink utilized is a phase-change or hot-melt ink which is a solid at room temperature. The printer operates on the principle that when a portion of the solid ink contained in the holes of the printing plate is heated, it undergoes a volume expansion (due to its change from a solid state to a liquid state) which causes ink to protrude out of the holes which have been heated. After the ink has been expanded in certain holes, a printing medium is brought into contact with the liquified ink for transfer thereto. The printing medium must be brought into contact with the liquified ink before the ink is allowed to cool. Alternatively, the printing medium may be placed in contact with the printing plate prior to the volume expansion.

In Cielo et al., U.S. Pat. No. 4,275,290, a thermally activated liquid ink printer is described. The printer includes an ink reservoir having a plurality of orifices. The driving force of the printer is the application of localized heat to ink in an orifice which causes at least partial vaporization of the ink and/or reduction in the surface tension. As a result, ink flows out of the orifices being heated. Preferably, the heating produces bubbles which cause ink drops to be ejected. Alternatively, the heating acts only to reduce surface tension which causes ink to flow through the orifices being heated. This alternative operation uses a hydrostatic pressure which is less than the surface tension of unheated ink at the ink surface.

In Cielo et al., U.S. Pat. No. 4,164,745, a method is described for varying the amount of ink deposited on a sheet of paper moving past an orifice based on the viscosity of the ink. For example, the width of a line being printed can be controlled. The method described is unable to completely control the flow of ink. That is, the flow of ink is continuous. It is only the amount of ink flowing which is variable. In this regard, Cielo et al. ('745) provides a bypass to prevent the continuous flow of ink from flowing out of an orifice across a gap onto paper, but only while the viscosity is above a predetermined value. The ink which does flow out from an orifice must cross a gap before it reaches the paper.

As will become more apparent below, the present invention provides a novel and nonobvious technique for printing which has the potential for a wide range of applicability. The present invention overcomes many of the disadvantages of known printing techniques because it has not only a simple and reliable design, but also the ability to use a wide variety of inks to achieve high resolution printing. The technology associated with the present invention is applicable to printers, digital copiers, video printers, facsimile machines, etc. Color and gray scale printing or copying are also available with this technology.

Furthermore, the known prior art failed to appreciate the advantages and benefits of viscosity driven printing. The present invention can easily and accurately control printing by altering the viscosity of the ink. Such control is superior to that provided by bubble, phase-change or surface tension driven printing. Cielo et al. ('745) assumes that the ink always flows through the orifices, and attempts to control the amount of ink deposited on paper using ink viscosity. Bupara operates on volume expansion solid ink as its phase changes from solid to liquid. The Bupara technique is very cumbersome and time consuming in that it requires a large number of procedures to transfer ink to paper. Cielo et al. ('290) operates either in a vaporization mode in which ink is ejected out of orifices across a gap to paper or in a surface tension and pressure mode in which ink under pressure flows out of orifices when heat is applied to the orifices. The vaporization mode of Cielo et al. is similar to a bubble-type ink jet and, therefore, very dissimilar to the present invention. The surface tension and pressure mode of Cielo et al. has questionable operability. Namely, it is unclear how ink transfer will take place because the paper never contacts the orifice plate. Furthermore, it would be very difficult, if not impossible, to construct a practical printer which relies on surface tension to control the printing process.

Although it is known that surface tension and viscosity vary with temperature, the magnitude of change between surface tension and viscosity is drastically different. Table 1 (below) shows that the viscosity change of fluids resembling ink is quite drastic over an 80° C. temperature change in comparison to the slight change in surface tension. The well known fluids of glycerol and ethylene glycol are used to model characteristics of inks which would be useful in the present invention.

TABLE 1

| | VISCOSITY (cps) | | SURFACE TENSION (dyne/cm) | |
|---|---|---|---|---|
| Temperature (Celsius) | 20 | 100 | 20 | 100 |
| Glycerol | 1410 | 16 | 63.3 | ~60 |
| Ethylene Glycol | ~19 | 2.3 | 48.43 | 41.31 |

As shown in Table 1, the magnitude of change in viscosity far exceeds the change in surface tension. This large magnitude of viscosity change provides a high level of control which is necessary to manufacture a reliable, low cost product. In contrast, a device relying on surface tension would be difficult to control because the magnitude of change in surface tension over a reasonable temperature change is not significant from a design or engineering standpoint.

In sum, the known prior art fails to appreciate the benefits and advantages of a printer which is driven by a viscosity change in ink.

SUMMARY OF THE INVENTION

In the present invention, an ink transfer printing device includes an ink reservoir for retaining ink held under pressure. The ink reservoir is associated with an ink transfer surface which has a plurality of perforations. The operating principle of the present invention is to drive the ink transfer process by changing the viscosity of the ink near certain of the perforation. The viscosity of the ink near each of the perforations can be changed using a number of techniques, including thermal, magnetic and electric techniques.

Under ambient conditions, the viscosity of the ink prevents flow of the ink through the perforations of the ink transfer surface. However, a change in viscosity of the ink near certain of the perforations causes a controlled amount of the ink near each of these certain perforations to flow through these certain perforations and onto the ink transfer surface. That is, the ink flows only after the viscosity of the ink is changed.

The ink which has flowed onto the ink transfer surface forms ink dots on the ink transfer surface above these certain perforations. The ink dots can then be transferred to a printing media, thereby printing an image. The ink dots may be transferred by contacting the printing media with the ink transfer surface. Alternatively, it may be preferable to initially transfer the ink dots to an intermediate surface and, thereafter, transfer the ink dots from the intermediate surface to the printing media.

The present invention offers a number of benefits, including the following. The printing technique of the present invention is capable of high speed and high resolution printing. In addition, the printing technique can perform gray scale toning, continuous toning and full color printing when printing an image. The printing technique of the present invention can also achieve excellent print quality on a variety of printing media using a wide range of inks. Moreover, the printing technique can be engineered to print a character, a line, or a page at a time.

BRIEF DESCRIPTION OF THE DRAWINGS

The present invention will be readily understood by the following description in conjunction with the accompanying drawings, wherein like reference numerals designate like structural elements, and in which.

DETAILED DESCRIPTION OF THE PREFERRED EMBODIMENTS

Figure 1:
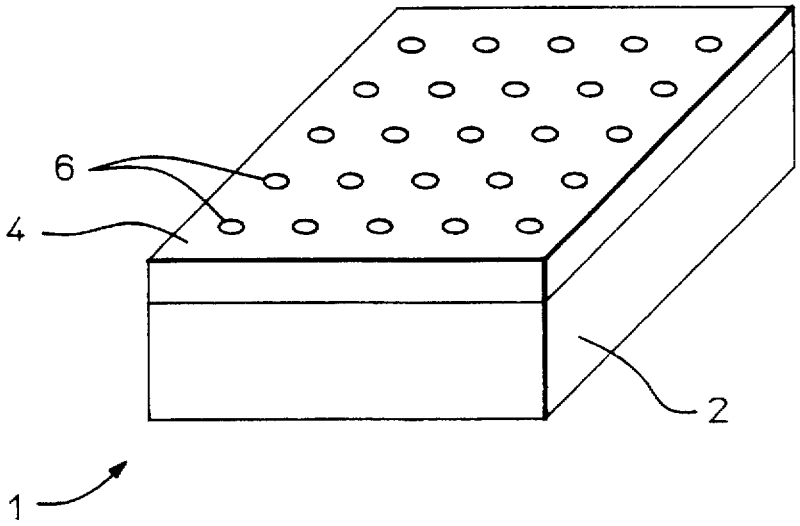
FIG. 1 is a three-dimensional diagram of a perforated ink transfer device which includes an ink reservoir and a perforated sheet according to the present invention.

FIG. 1 illustrates a perforated ink transfer device 1 which includes an ink reservoir 2 and an ink transfer surface 4 (contact surface). The ink reservoir 2 retains ink which is used for printing. The ink transfer surface 4 has a plurality of orifices 6. Each orifice 6 of the ink transfer surface 4 corresponds to an ink dot which may be printed on a printing media.

Before explaining the detailed operation of the ink transfer device 1, it is useful to discuss the physical features of the ink reservoir 2 and the ink transfer surface 4. Generally speaking, the size, shape and construction of both the ink reservoir 2 and the ink transfer surface 4 are very flexible.

More particularly, in FIG. 1, the ink transfer surface 4 is a flat perforated sheet. However, various other perforated surfaces may be used (see e.g., FIGS. 11, 13A–13E). Hence, the size and shape of the ink transfer surface 4 is not critical. For example, the ink transfer surface 4 may be cylindrically shaped with a circumference which is less than, equal to, or greater than, the length of a page.

Figure 3:
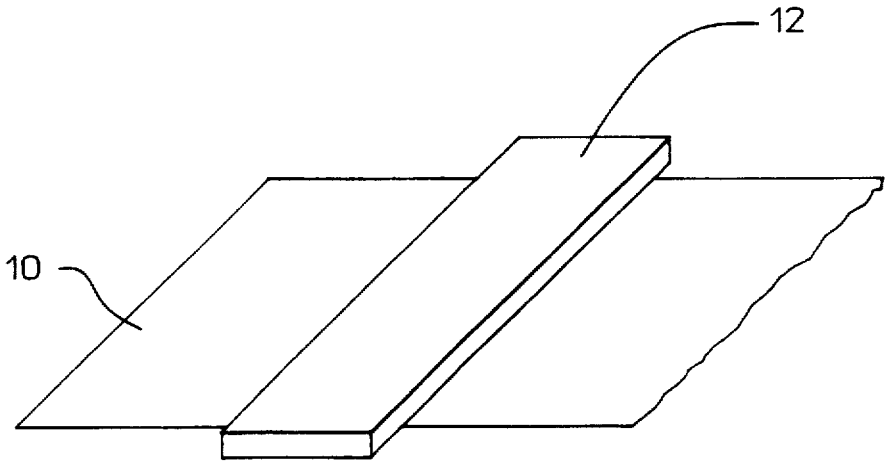
FIG. 3 is a three-dimensional diagram illustrating a line printhead in comparison to a page to be printed.
Figure 2:
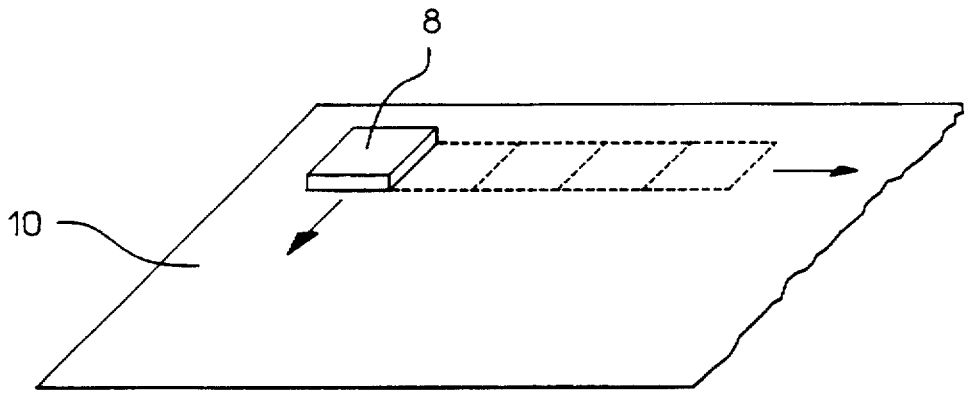
FIG. 2 is a three-dimensional diagram illustrating a small printhead in comparison to a page to be printed.

It may be preferable to size the ink transfer surface 4 so that it slightly exceeds the size of a page of paper (i.e., page size ink transfer surface). A page size ink transfer surface 4 would increase printing speed by transferring ink a page at a time. Printing a page at a time is typically faster than printing a character or line at a time because the printing media need only contact the ink transfer surface 4 once every page. On the other hand, as illustrated in FIG. 2, the ink transfer device 1 may form a printhead 8 in which the length and width of the ink transfer surface 4 may be relatively small compared to the size of a page. In such case, the printhead 8 must contact a printing media 10 several times for each page to be printed (see dashed lines in FIG. 2). The printhead 8 can also have a variety of sizes and shapes. For example, as illustrated in FIG. 3, the printhead could be a line printhead 12 which would print a line at a time.

Thus, the physical features of the ink transfer device 1 are not critical. Hence, the size, shape and configuration of the ink transfer device 1 (ink reservoir 2 and ink transfer surface 4) can be designed for specific applications.

The present invention is able to achieve a wide range of resolutions, namely, from a low resolution of 10 dpi (dots per inch) to a very high resolution in excess of 1000 dpi. Each dot corresponds to an orifice 6 in the ink transfer surface 4. Consequently, an ink transfer device having 600 dpi will have 36,000 orifices per square inch.

Although the shape of the orifices 6 shown in FIG. 1 is circular, the shape of the orifices 6 is not critical. For example, the orifices 6 could be oval or square. The size of the orifices 6 in the ink transfer surface 4 ranges from 10 μm to 200 μm depending on the printing resolution desired. The thickness of the orifices 6 ranges from 10 to 500 μm, depending on the resolution and applications desired. The orifices 6 are formed by micromachining processes, such as laser ablation, wet etching or plasma etching, which are generally known in the semiconductor processing art.

The ink transfer surface 4 (e.g., perforated sheet) can be made from a wide variety of materials. More particularly, the perforated sheet 4 can be formed from a stainless steel mesh screen, electroformed of nickel, or made from processed polyimide (e.g., KAPTON or UPILEX from E. I. DuPont Company and Ube Company of Japan, respectively).

The operation of the ink transfer device 1 is explained in detail below.

Figure 4:
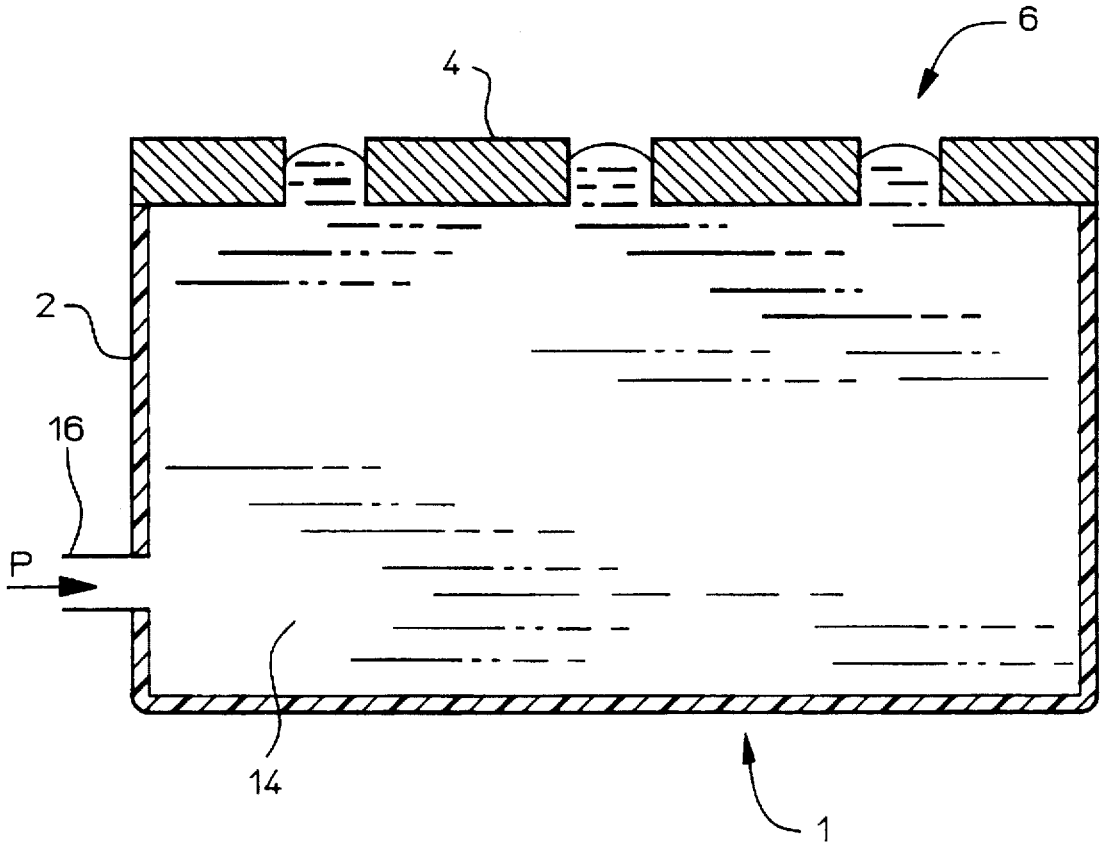
FIG. 4 is a cross-sectional diagram of a perforated ink transfer device in a non-printing state.

In FIG. 4, a cross-sectional view of an ink transfer device 1 in a non-printing state is illustrated. The ink reservoir 2 contains ink 14. The viscosity of the ink 14 at room temperature is preferably greater than 20 centipoise (cps). A wide variety of inks including inexpensive commercial ones are able to (or can be easily made to) satisfy the viscosity requirement of the present invention. A pressure inlet 16 to the ink reservoir 2 places a positive pressure on the ink 14. The amount of pressure on the ink 14 is dependent on the viscosity of the ink 14 and the geometry of the orifices 6. For example, in experiments using glyercol with 50 μm orifice diameter and 125 μm thickness, the inventors successfully used an applied pressure on the order of 8–20 Torrs. Preferably, the applied pressure is constant so that the volume of ink within each ink drop is constant.

The viscosity of the ink 14 at room temperature is normally high so that the ink transfer device 1 is normally in the non-printing state. That is, due to the high viscosity of the ink 14 within the ink reservoir 2, the pressurized ink 14 will not flow through the orifices 6 of the ink transfer surface 4. In a technical sense, over several years some flow within the orifices 6 may be observed, but the flow would not be noticeable to the eye.

Accordingly, in the non-printing state, ink does not flow or protrude out of the orifices 6 of the ink transfer surface 4 even though a positive pressure is applied via the pressure inlet 16. That is, for a particular ink 14 being utilized, the applied pressure is not so great as to cause the ink to flow through the orifices 6 while at room temperature. Thus, regardless of whether the printing media 10 is brought into contact with the ink transfer surface 4, no ink can be transferred to the printing media 10 while the ink transfer device 1 is in the non-printing state.

On the other hand, the ink transfer device 1 can be switched to a printing state wherein ink can be selectively transferred to the printing media 10. The device 1 switches from a non-printing state to a printing state on an orifice-by-orifice basis by locally changing the viscosity of the ink associated with each orifice 6.

When the normally high viscosity of the ink 14 is reduced, the ink 14 having the lowered viscosity flows through the orifices 6 onto the ink transfer surface 4 to form an ink dot. Although the ink 14 with the reduced viscosity may flow onto the ink transfer surface 4 by capillary action, the ink 14 within the ink reservoir 2 should be pressurized with a small positive pressure via the pressure inlet 16. The pressure applied to the ink reservoir 2 is set such that it is sufficient to push the ink with the reduced viscosity through the orifices 6, but not so high as to cause the non-reduced viscosity ink to flow through the orifices 6. The ink transfer process is explained in more detail with reference to FIG. 5A.

Figure 5A:
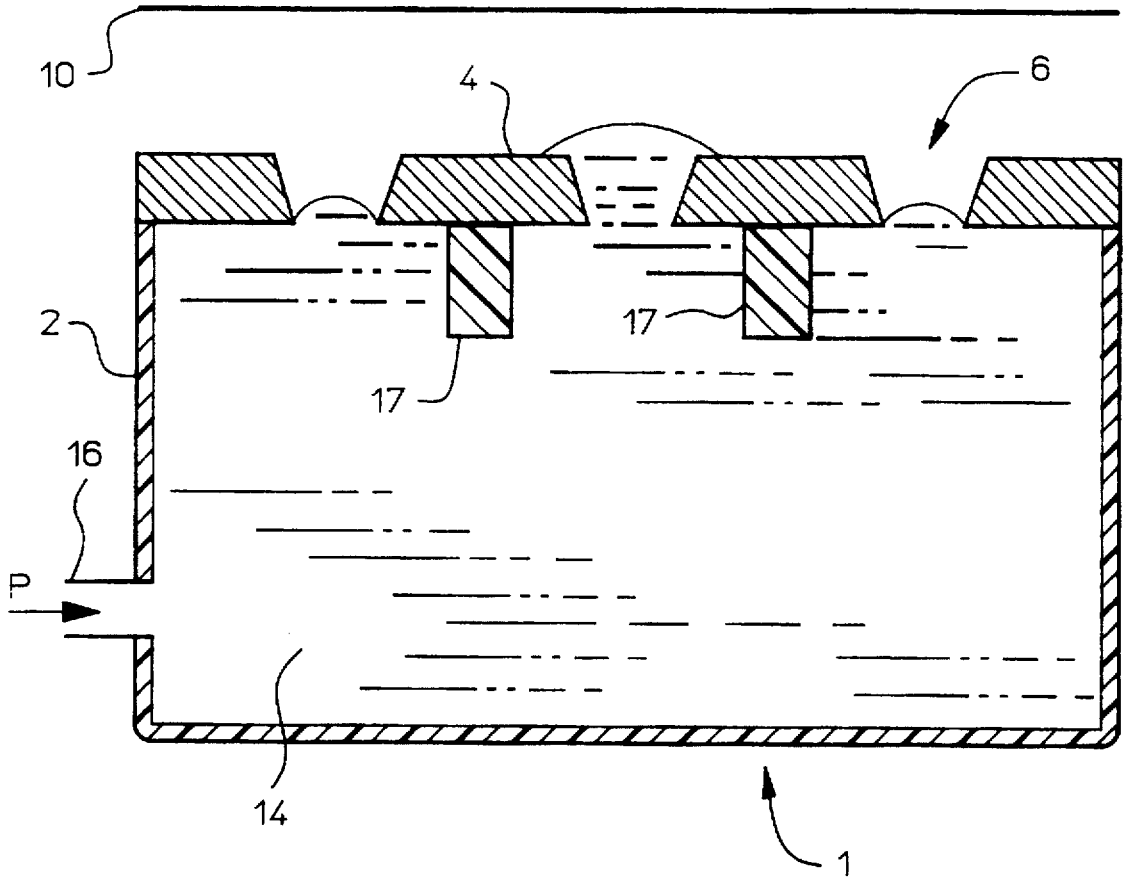
FIG. 5A is a cross-sectional diagram of a perforated ink transfer device in a printing state.

FIG. 5A is a cross-sectional diagram of an ink transfer device 1 in a printing state. FIGS. 4 and 5A as basically the same structurally except that the device in FIG. 5A includes divergent orifice walls as well as thermal barriers 17 which are discussed in more detail below. Although the orifice walls shown in FIG. 5A are divergent, the orifice wall could also be convergent or straight as shown in FIG. 4. The orifices 6 could also be divergent.

In FIG. 5A, three orifices 6 of the ink transfer surface 4 are illustrated. However, as shown in FIG. 5A, ink has flowed to the ink transfer surface 4 only through the middle orifice 6. The ink which has flowed onto the ink transfer surface 4 via the middle orifice 6 is transferred to the printing media 10 by bringing the printing media 10 into contact with the ink transfer surface 4 of the ink transfer device 1. The ink transfer surface 4 is then devoid of any ink (although some microscopic residue will exist) and may be reused immediately.

In FIG. 5A, only the viscosity of the ink 14 near the middle orifice 6 has been reduced. As a result, the ink 14 near the middle orifice 6 was able to flow through the middle orifice 6 onto the ink transfer surface 4 primarily due to the pressure applied via the pressure inlet 16. On the other hand, the viscosity of the ink 14 near the left and right orifices 6 has not been reduced and, therefore, remains high enough to prevent the applied pressure from pushing the ink through the left and right orifices 6. Thus, as shown in FIG. 5A, the ink 14 near the left and right orifices 6 has not flowed to the ink transfer surface 4.

Figure 5B:
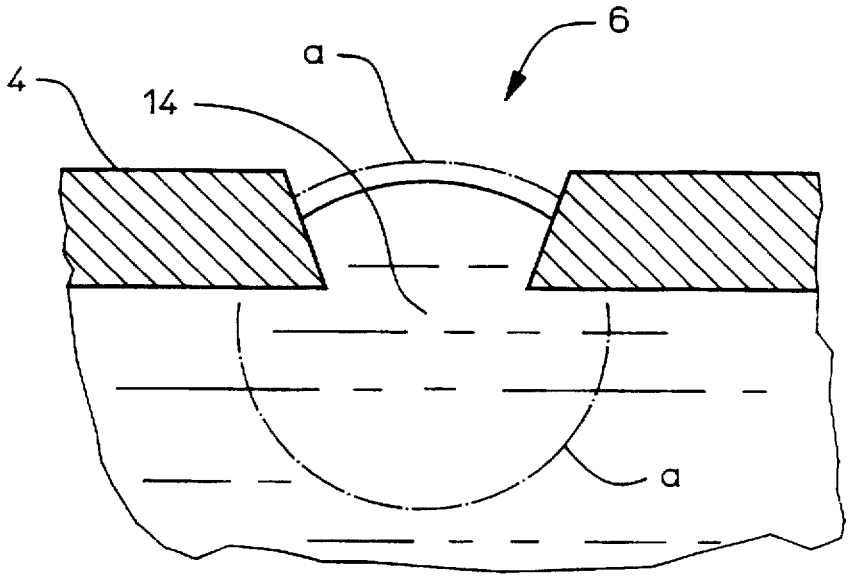
FIG. 5B is a detailed cross-sectional diagram of an orifice of the ink transfer device illustrated in FIG. 5A.

FIG. 5B is a detailed view of an orifice 6 of the ink transfer device 1 shown in FIG. 5A. FIG. 5B is provided to explain what is meant by lowering the viscosity of the ink which is near (or in close proximity to) a particular orifice. In FIG. 5B, an orifice 6 is shown partially filled with ink and directly coupled to the ink reservoir 2 below the orifice 6. The dot-dash line (a) provided in FIG. 5B indicates the portion of the ink 14 in which the viscosity is reduced, that is, the ink which may be deemed near the orifice 6. However, in practice, other portions of the ink which are further from the orifice 6 will also undergo a viscosity change but to a lesser extent. Nevertheless, the idea is to reduce the viscosity of the ink beginning with the ink closest to the orifice 6 so that a predetermined amount of ink will flow through the orifice 6 to the outer surface of the ink reservoir 2 to produce an ink dot having a particular size. Depending on the technique used, orifice size, viscosity of ink at ambient conditions, pressure, size of ink dot desired, etc., the actual operating parameters can easily be determined experimentally.

It is important that the viscosity of the ink 14 be reduced only near the orifices 6 from which ink 14 is to flow. By selectively reducing the viscosity of the ink 14 near the orifices 6 from which an ink dot or pixel is desired, an image can be printed. That is, each orifice 6 represents an ink dot on the printed image. If the viscosity of the ink 14 near a particular orifice has been reduced, an ink dot will be produced on the printed image at a location corresponding to the particular orifice. On the other hand, if the viscosity of the ink 14 near the particular orifice has not been reduced, no ink dot will be produced on the printed image at the location corresponding to the particular orifice.

The ink, which has flowed to the ink transfer surface 4, remains on the ink transfer surface 4 until transferred to the printing media 10. That is, the reduced viscosity ink which has flowed to the ink transfer surface will not retreat back into the orifices from which it came, regardless of whether the viscosity of the ink returns to its normal viscosity level.

Consequently, the ink transfer process performed by the present invention is viscosity driven. Specifically, the viscosity of the ink is utilized as a switch. Normally, at ambient conditions, the viscosity of the ink is sufficiently high with respect to the applied pressure to prevent flow of the ink (i.e., switched off). On the other hand, at operating conditions, an ink dot is produced on a printed image (i.e., switched on) when the viscosity of ink near the orifice corresponding to the dot is lowered.

The viscosity of ink has the following functional relationships:

$$\text{VISCOSITY}=f[T, E, H, pH, hv],$$

where T is temperature, E is electric field, and H is magnetic field. Hence, the viscosity of the ink near certain orifices 6 can be lowered a number of different ways, including increasing temperature, applying an electric or magnetic field, lowering pH, and increasing hv. Temperature and hv are closely related in that increasing light intensity is one method of increasing temperature. Although it is critical that the viscosity of the ink be lowered, the method or technique used to lower the viscosity is not critical.

Regardless of the technique utilized, for reliable viscosity control, it may be preferable that the localized viscosity reduction be at least 50%. At room temperature (ambient conditions), the ink can be a solid ink or any viscous ink whose viscosity is greater than 10 cps. Preferably, the viscosity of the ink is greater than 100 cps. However, at operating conditions, the ink becomes a low viscosity liquid. Typically, the viscosity of the ink at operating conditions ranges from 1–100 cps. However, higher viscosities may be used if a corresponding higher pressure is applied.

Ambient conditions are defined as conditions in which the ink transfer device 1 is in a non-printing state. For example, at ambient conditions, no external exciting energy (thermal, electrical or magnetic) is applied to the device 1. As a result, all the ink within the ink transfer device 1 would be at room temperature or some actively controlled temperature. Operating conditions, on the other hand, are defined as conditions in which the ink transfer device 1 is in a printing state. For example, at operating conditions, external energy (thermal, electrical or magnetic) is applied to the device 1. The ink may or may not be at room temperature depending on the type of energy applied.

The ink composition is selected based on the method used to change the viscosity of the ink. For example, in an embodiment which uses a magnetic field to induce the change in viscosity, the ink contains magnetic toner like materials. Likewise, in an embodiment which uses an electric field to induce the change in viscosity, the ink is an electrorheological fluid such as described in "Design of Devices Using Electrorheological Fluids," SAE Technical Paper Series, #881134, by T. Ducios of Lord Corporation (1988).

In an embodiment which thermally induces a reduction in viscosity, the ink may be composed of: colorant 2–10% (by weight); carriers(s) 93–60%; additives 5–30%. The colorant can be either dye or pigments. The carrier or vehicle materials can be waxes, monomers, oligomers or polymers. The waxy materials, for example, include natural waxes such as carnauba wax and synthetic waxes such as stearic acid derivatives. The monomeric, oligemic and polymeric carrier materials include acrylic, vinyl derivatives, ester type of monomers and copolymers. The carrier materials also include glucose derivatives and rosin derivatives. The vehicle or carrier can also be a mixture of a solvent such as water and a viscous liquid such as glycol series (ethylene glycol, diethylene glycol, propylene glycol, butanediol, glycerol, etc.) and polyethylene glycol series. The ink vehicle or carrier can also include commercial lithographic, screen printing, gravure ink. The additives include, for example, various types of surfactant and viscosity reducers, hardening and toughening agents, optical property (transparency) and solubility improver of dyes. Additives may not be a critical requirement. Nevertheless, the purpose of the additives is to modify the viscosity and surface tension of the ink so as to improve print quality and system reliability.

One way to control the viscosity of the ink 14 is with temperature. At room temperature, the ink 14 preferably has a viscosity of at least 20 cps. However, as the temperature of ink 14 increases, the viscosity of the ink 14 decreases. Table 1 shows the magnitude of viscosity change over 80° C. temperature change for several fluids representative of inks. Namely, the viscosity of glycerol was reduced by about 95%, and the viscosity of ethylene glycol was reduced about 70%.

Thus, the application of localized heat will act to induce the flow of ink 14 from the ink reservoir 2 to the ink transfer surface 4 via the orifices 6. More particularly, the application of heat to certain orifices causes the ink near these orifices to be heated. The heating of the ink lowers the viscosity of the ink. When the viscosity of the ink falls below a critical level, the applied pressure causes the heated ink to flow through the corresponding orifices to the ink transfer surface 4.

FIGS. 6A–6D illustrate various structures which may be used to locally heat the ink 14 near certain of the orifices 6 to thereby lower its viscosity.

Figure 6A:
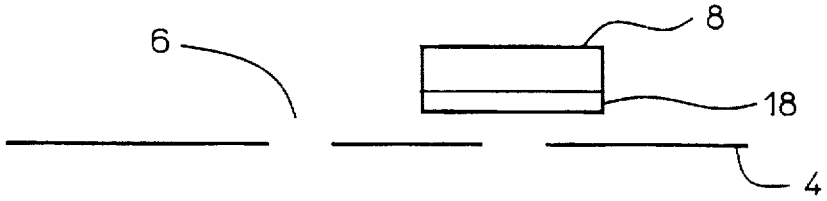
FIGS. 6A–6D are schematic diagrams illustrating various techniques for supplying thermal energy to selective orifices.

In FIG. 6A, a thermal printhead 8 is shown having a heating element 18. The heating element 18 is placed near (preferably over) each of the orifices 6 from which an ink dot is desired. When so placed, the heating element 18 acts to heat the ink near the orifice 6 over which the printhead 8 is placed by providing a heat flux to the ink contained in the orifice 6. The heated ink then flows to the surface of the ink transfer surface 4 (perforated sheet) where it remains until transferred to the printing media 10. Therefore, a printed image can be produced by moving the thermal printhead 8 over each of the orifices 6 from which an ink dot is desired.

One significant advantage of the present invention is that the printhead 8 may heat each of the orifices 6 for an entire page before transferring any of the ink produced thereby to the printing media 10. This is because once the ink has flowed onto the ink transfer surface 4 via a particular orifice 6, the ink which has so flowed need not remain heated. That is, the ink may cool once it reaches the ink transfer surface 4 because it will not drain back into the orifice 6 from which it came. Thus, the ink will remain on the ink transfer surface 4 until it is transferred to the printing media 10. This advantage occurs regardless of the method used to induce the viscosity reduction (e.g., T, E, H, pH, hv). As a result, the size of the printhead 8 can vary from very small such that only the ink near a single orifice would be heated at a time (see FIG. 6A) to very large such that all of the orifices could be heated at the same time. A reasonable compromise of speed and cost would lead to a printhead 8 somewhere in between the two extremes, perhaps a line printhead such as illustrated in FIG. 3.

Figure 6B:
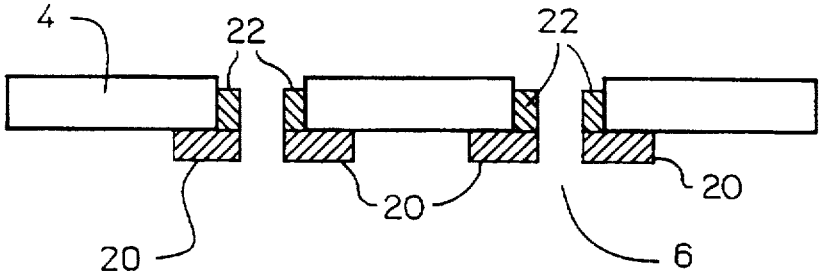

In FIG. 6B, heaters 20 (resistors) and thermal conductors 22 are used to provide the thermal energy necessary to selectively lower the viscosity of the ink 14 near certain orifices 6. Although the heaters 20 are shown as being attached to the under side of the ink transfer surface 4 at each orifice 6, the heaters 20 may be positioned in any manner provided each is closely associated with an orifice 6. For example, the heaters 20 may be recessed within the perforated sheet 4 itself.

Preferably, each heater 20 has a thermal conductor 22 coupled thereto to facilitate the transfer of heat from the heater 20 to the ink 14 in the corresponding orifice. It is preferable to symmetrically heat the ink near an orifice 6 to obtain uniform heating. For example, the heater 20 could have either a ring shape or four small heaters could be equally spaced around each orifice.

Figure 7:
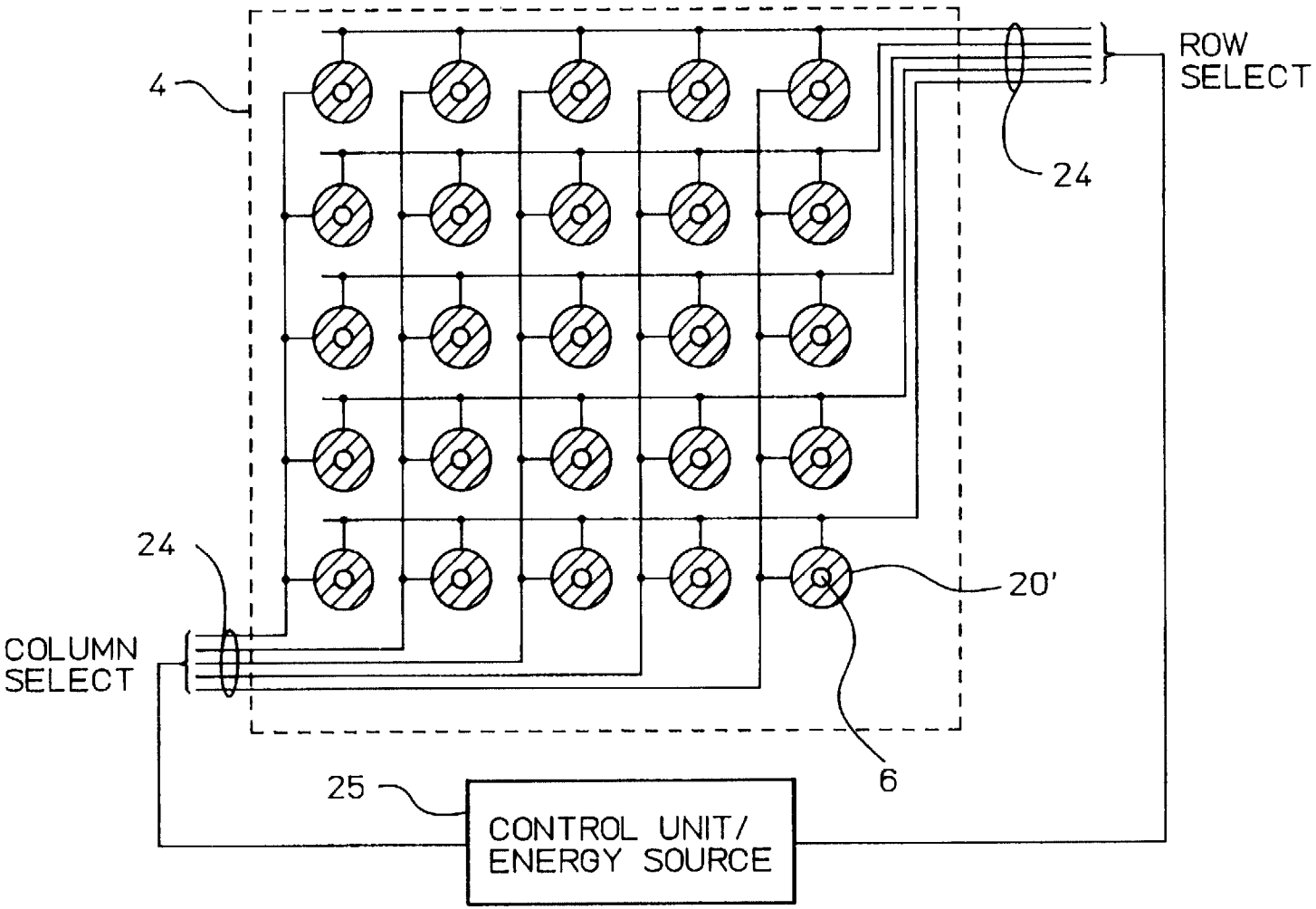
FIG. 7 is a top view diagram illustrating a matrix of wires connected to resistors which are coupled to each of the orifices.

FIG. 7 illustrates a layer of an ink transfer surface 4 having coaxial resistors 20' at each orifice 6 connected together in matrix fashion by wires 24. FIG. 7 also illustrates a control unit/energy source 25 for controlling the supply of electrical energy to the resistors 20'.

The ink transfer surface 4 is made from a wide variety of materials such as ceramics, glass, plastic, etc. The wires 24 enable each coaxial resistor 20' to be individually addressed so that electrical energy can be supplied to those coaxial resistors 20' which correspond to orifices 6 from which an ink dot is desired. The heaters 20 and 20' as well as the wires 24 can be formed by thick film or thick film processes which are well known techniques.

The back side of the ink transfer surface 4 (perforated sheet) may include a thin-film structure consisting, for example, of a glass substrate, a resistor layer, metallic electrical conductors, and a passivation layer. The thin-film structure is similar to that of a ThinkJet® printhead which is well known in the art and described in detail in Volume 36, No. 5 of *Hewlett-Packard Journal*, particularly the article entitled "Development of the Thin-Film Structure for the ThinkJet Printhead" beginning on page 27 of that journal. However, since ink bubble generation is not required, the thin-film structure for the present invention is more simplified. Unlike an ink jet device which positions the resistor layer on the substrate and below the orifices, the present invention positions the resistor layer so that the heat produced thereby is very close to the orifices 6. For example, in FIG. 6B, the heaters 20 are coaxial with the orifices and affixed to the inner surface of the ink transfer surface 4. Alternatively, the heaters 20 could be placed either in the orifices themselves or on the outer surface of the ink transfer surface 4. This embodiment can sufficiently lower the viscosity of the ink in the orifices in about 100 microseconds. Further, the thermal conductors 22 may be utilized to assist in heating the ink within the orifices.

The electrical energy supplied to the heaters is dependent on a number of parameters, e.g., the composition of the ink, resistance, voltage, pulse width, and period. These parameters can be readily determined for specific designs. Even so, it is believed that a thermal embodiment (FIG. 6B) which uses a glycerol based ink could be successfully operated using heaters with a resistance between 5 and 200 ohms, and applied pulses with a voltage between 0.5 and 50 volts and a pulse width between 5 μsec and 4 msec.

Figure 6C:
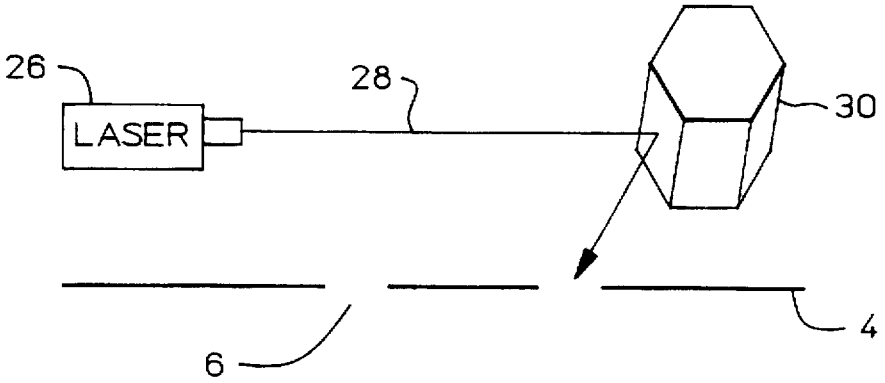
Figure 6D:
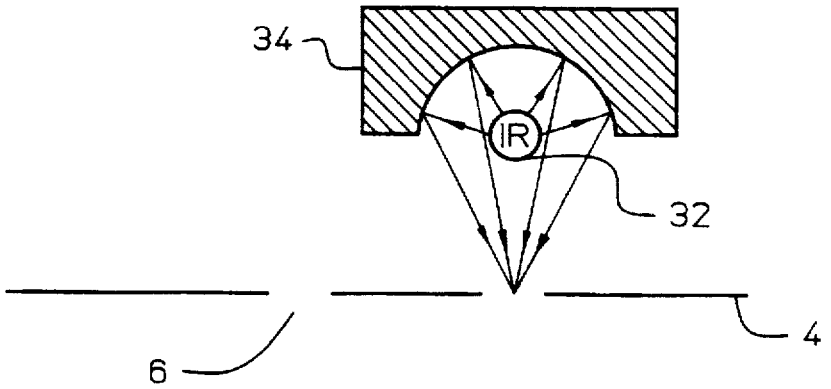

FIGS. 6C and 6D illustrate that the thermal energy may be supplied to the ink near the orifices 6 using light (hv). The light can, for example, be provided by a laser beam, an infrared lamp, a flash lamp, an ultraviolet lamp, or an incandescent lamp. In FIG. 6C, a laser 26 produces a laser beam which is reflected from a mirror 30 to a given orifice 6 of the ink transfer surface 4. This type of set-up can easily and rapidly address each of the orifices 6 of the ink transfer surface 4 so that the ink may be locally heated by the laser beam. In FIG. 6D, an infrared light (IR) source 32 and a reflective housing 34 are used to focus infrared light to the orifices 6 of the ink transfer surface 4. Other types of light sources may be utilized to heat the ink in the orifices.

Alternative ways to control the viscosity of the ink 14 involve applying an electric field (E), applying a magnetic field (M) field, or lowering pH. Since lowering pH is closely related to applying an electric field (i.e., the application of an electric field operates to lower pH), this way will not be separately discussed.

Figure 8A:
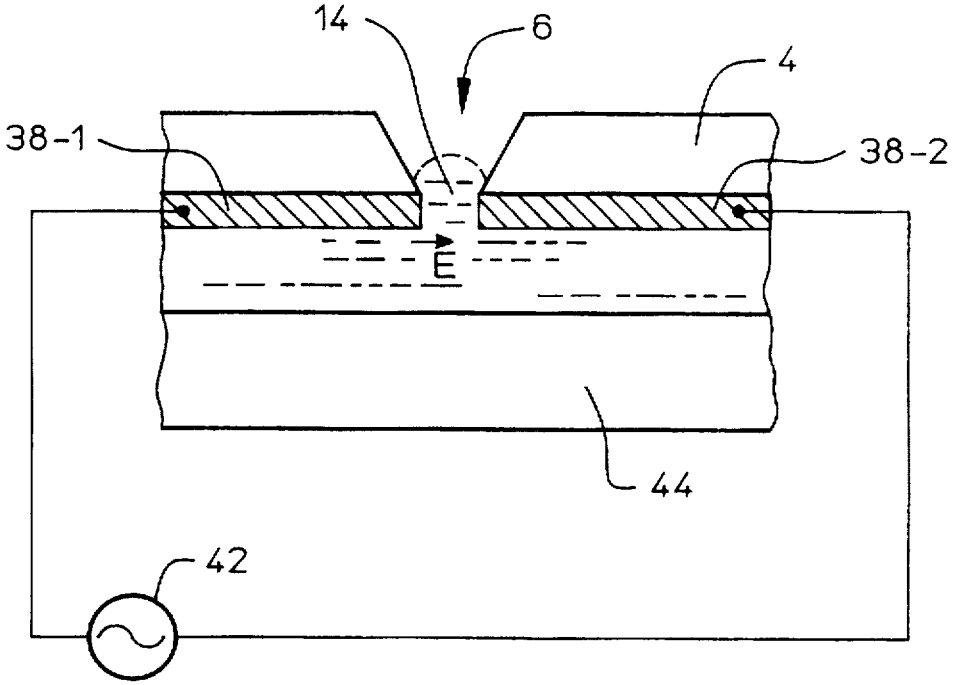
FIGS. 8A and 8B are cross-sectional diagrams illustrating embodiments for applying an electrical field to selective orifices.
Figure 8B:
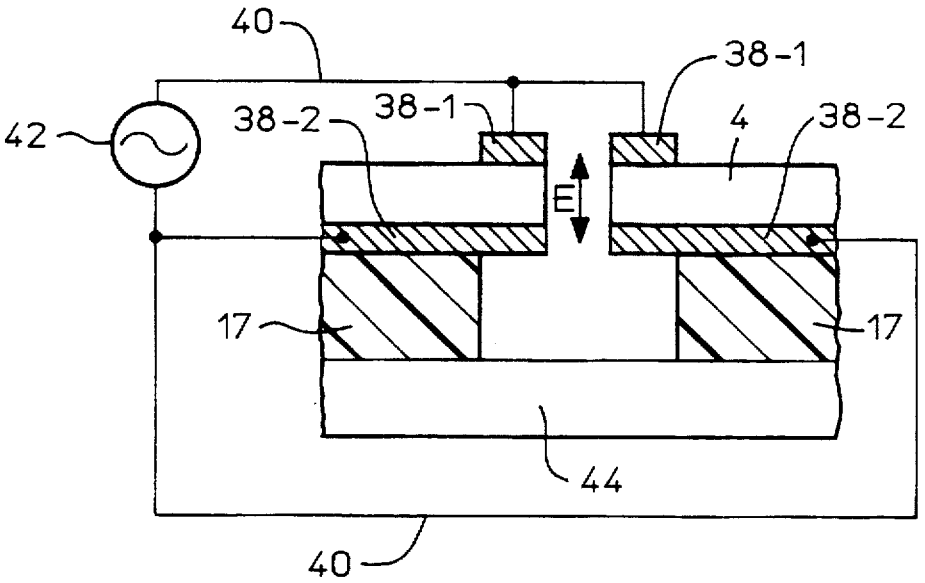

FIGS. 8A and 8B illustrate embodiments of the present invention in which an electric field is produced to induce the reduction in viscosity. In FIG. 8A, electrodes 38-1, 38-2 are provided on the under side of the ink transfer surface 4. The electrodes 38-1, 38-2 are connected by conductors 40 to an AC generator 42. The AC generator 42 operates, under the control of a control unit (not shown), to induce an electric field E in the orifice 6 of the ink transfer surface 4 to thereby reduce the viscosity of the ink 14 near the orifice 6. In FIG. 8B, the electrodes 38-1, 38-2 are orientated differently. In particular, the electrode 38-1 is an upper electrode and electrode 38-2 is a lower electrode 40. In addition, thermal barriers 17 (described below) are provided in this embodiment. Many other electrode configurations can be used to produce the necessary electric field. For example, a roller or platen which provides the printing media 10 to the ink transfer device 1 could even be used as an upper electrode.

Figure 9:
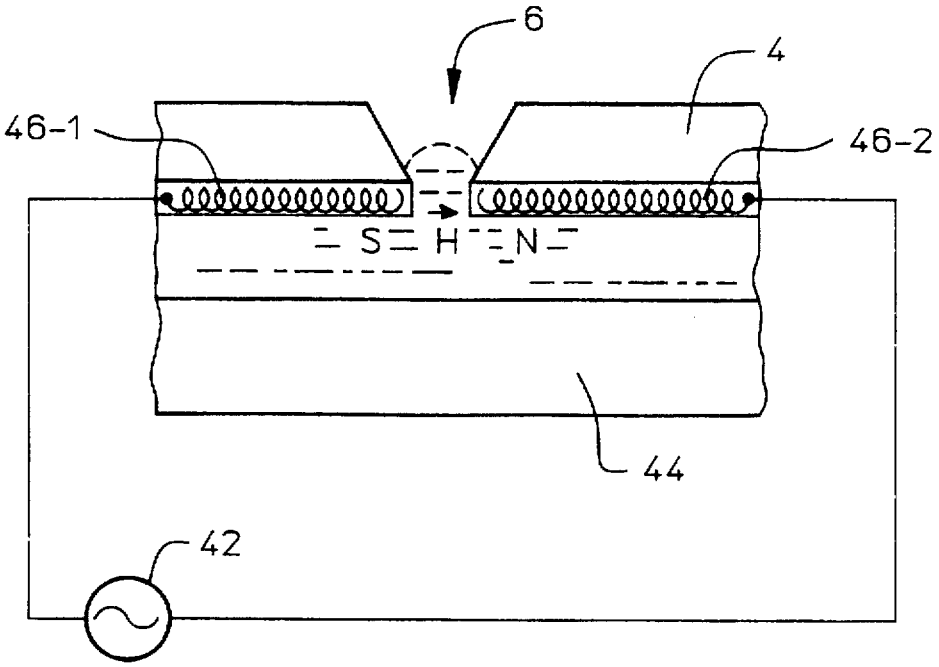
FIG. 9 is a cross-sectional diagram illustrating an embodiment for applying a magnetic field to selective orifices.

FIG. 9 illustrates an embodiment of the present invention which provides a magnetic field (H) to selective orifices to induce a reduction in viscosity. This embodiment is structurally similar to FIG. 8A except that coils 46-1, 46-2 are used instead of electrodes 38-1, 38-2. The coils 46-1, 46-2 can be fabricated using techniques which are used in producing magnetic recording thin film heads. When the coils 46-2, 46-2 are activated by the AC generator 42, a magnetic field H is produced in the orifice 6. The magnetic field H causes a reduction in the viscosity of the ink near the orifice 6. Many other configurations are possible so long as a magnetic field is produced near the orifice.

An optional feature of the present invention is to thermally isolate the ink 14 at each of the perforations. Thermal isolation improves the performance of the ink transfer device by decreasing heat loss to surrounding ink and guarding against cross-talk between the orifices 6.

The ink transfer device 1 illustrated in FIG. 5A includes thermal barriers 17 which serve to provide thermal isolation between nearby orifices 6. More particularly, the barriers 17 function to decrease heat loss to the surrounding ink within the ink reservoir 2 and to guard against cross-talk between neighboring orifices. The barrier 17 shown in FIG. 5A is coaxial with the middle orifice 6 so as to thermally isolate the ink 14 near the middle orifice 6 from the ink near other orifices. The barrier 17 extends from the inner surface of the ink transfer surface 4 downward about 50 μm into the ink reservoir 2. The barriers 17 can be made using a number of conventional techniques, such as etching, deposition, or a photo-imagable dry film resist (e.g., RISTON or VACREL, which are trade names for polymer materials of the E. I. DuPont Company of Wilmington, Del.). The depth and configuration of the barriers 17 discussed above are not critical.

Figure 11:
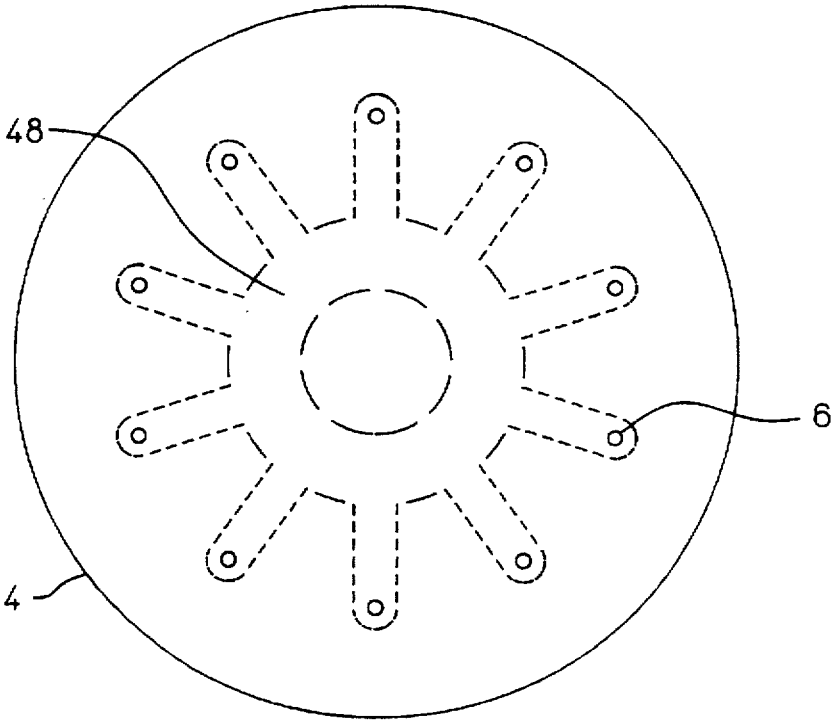
FIG. 11 is a top view diagram illustrating an ink channel formed under a circular printhead.
Figure 10A:
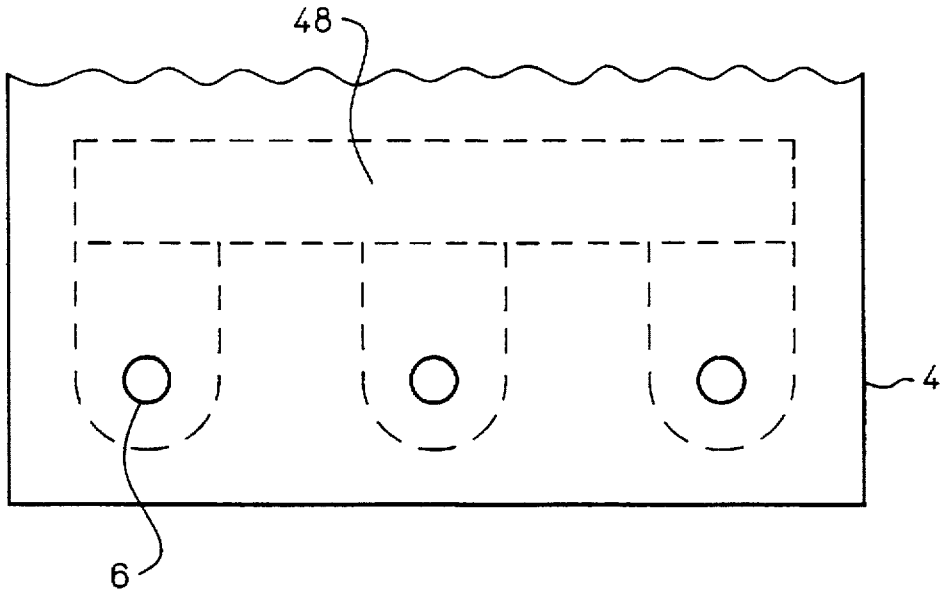
FIG. 10A is a top view diagram illustrating an ink channel formed under a perforated sheet.
Figure 10B:
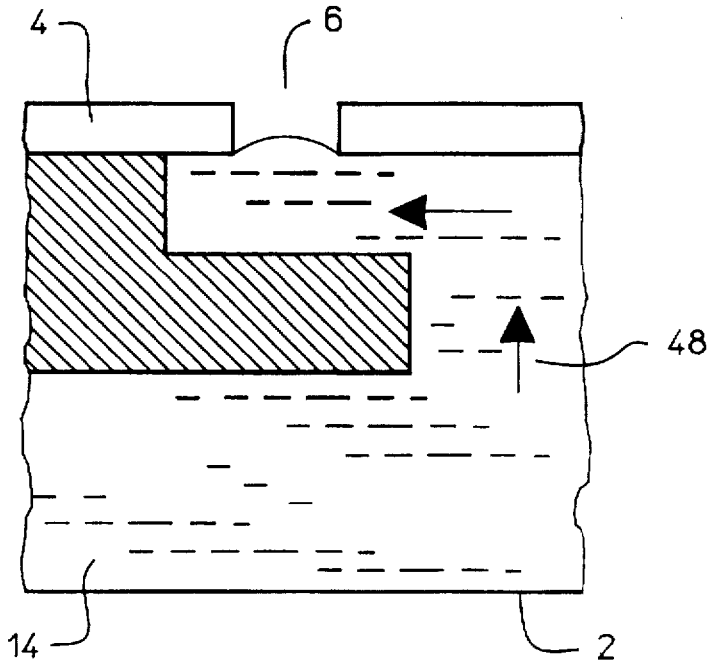
FIG. 10B is a side view diagram illustrating the ink channel shown in FIG. 10A.

The structural design of ink channels within an ink reservoir can also provide thermal isolation between orifices. Namely, by isolating portions of the ink in ink channels which feed ink to certain orifices, some thermal isolation of the ink occurs. FIGS. 10A, 10B and 11 illustrate examples of ink channels 48 which may be used to provide thermal isolation between orifices 6. In such cases, the ink reservoir 2 is a main supply for the ink and the ink channels 48 receive ink from the main supply.

In FIG. 10A, the ink channels 48 supply ink 14 to orifices 6. As a result, the ink associated with a particular orifice is thermally isolated from other orifices 6. FIG. 10B illustrates a side view of the ink channel 48 shown in FIG. 10A. The ink 14 within the ink reservoir 2 is supplied to an orifice 6 via the channel 48. Within the ink channel 48, ink initially flows up from the reservoir 2 and then over to an orifice 6. Hence, the ink 14 is supplied to the orifice 6 in a direction which is perpendicular to the direction in which ink 14 flows out of the orifice 6 during a printing state.

FIG. 11 illustrates a top view of a circular printhead 4, 8 in which the orifices 6 are arranged in a circular pattern. The ink channel 48, shown in FIG. 11, supplies ink 14 to all of the orifices 6 of the printhead 4, 8. Again, like FIGS. 10A and 10B, the ink 14 is applied to the orifices 6 in a direction which is perpendicular to the direction in which ink 14 flows out of the orifice 6 during a printing state. The construction of the ink chamber 48 shown in FIG. 11 is further advantageous in that the pressure of the ink 14 at each orifice 6 is the same. On the other hand, using the construction of the ink chamber 48 shown in FIGS. 10A and 10B the pressure of the ink 14 at the orifices 6 is not as evenly distributed because a plurality of channels 48 are used and the ink path to each orifice 6 is not always the same length. Further, although the channels 48 reduce cross-talk, they also require a greater pressure than embodiments shown in FIGS. 4 and 5 which lack such channels.

Figure 12:
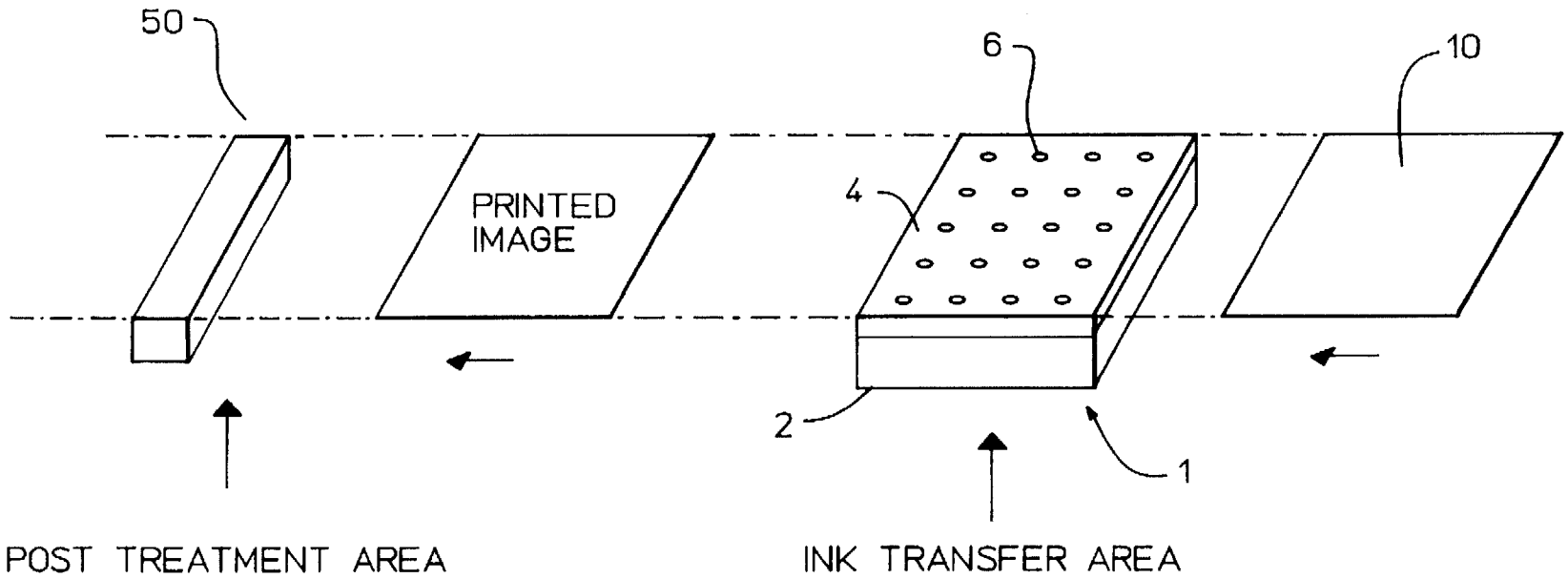
FIG. 12 is a three-dimensional diagram illustrating an ink transfer system which includes an ink transfer area and a post treatment area.

Another optional feature of the present invention is a post treatment area where the ink which has transferred to the printing media 10 would be rapidly fixed. FIG. 12 illustrates an ink transfer system which includes an ink transfer area and a post treatment area. The ink transfer area contains the ink transfer device 1 which has been described in detail above. The printing media 10 is supplied to the ink transfer area where the ink transfer device 1 acts to transfer ink to the printing media 10. At this point, the printing media 10 contains a printed image but the ink may be wet or tacky. Moreover, the image may not be durable and is often embossed. Hence, fixing or curing the images on the printing media 10 may be necessary. Next, the printing media 10 having the ink is delivered to the post treatment area where a thermal ink fixing unit 50 is provided. The thermal ink fixing unit 50 uses heat to fix and/or fuse the ink to the printing media 10. A wide range of thermal ink fixing units 50 may be employed. For example, the heat of the thermal ink fixing unit 50 could be provided by a laser beam, a light source, a heated roller or platen, or an oven. An additional advantage of using the heated roller or platen is that by slightly pressurizing the rollers the images may be flatted out.

Another optional feature of the present invention is to control of the size of the ink dots produced. Dot size control or modulation is useful in achieving continuous toning and multicolors. Dot size control for an ink transfer printing device is fully described in U.S. application Ser. No. 07/983,010 now U.S. Pat. No. 5,381,166, entitled "Ink Dot Size Control for Ink Transfer Printing" and filed concurrently (Attorney Docket HP-1092159), which is hereby incorporated by reference.

A further optional feature of the present invention is use of colored ink. More particularly, the present invention can be easily adapted to color printing. Since the present invention can use such a wide variety of inks, all that is really needed is to change the color of the ink within the ink reservoir. For example, on a basic level, the ink transfer device 1 can print in any color ink which is placed in the ink reservoir 2. However, to obtain full color printing, inks corresponding to the three primary colors of cyan, magenta and yellow as well as black must be simultaneously provided. Hence, full color printing can be provided by pre-aligning four ink transfer devices 1 relative to one another, each device having a different color ink. The construction of such a device would be relatively simple compared to existing color printers. Further, the numerous advantages of the present invention would remain, namely high resolution, inexpensive production and simple construction.

Figure 13A:
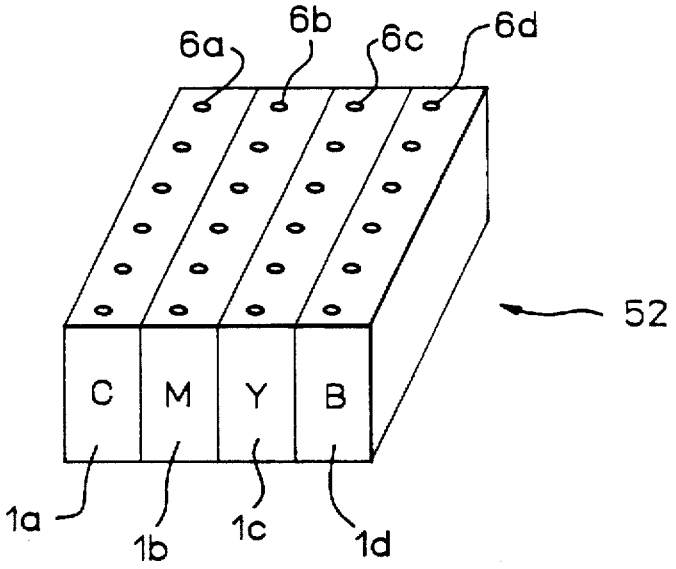
FIGS. 13A–13E are three-dimensional diagrams illustrating structural implementations for a color ink transfer device.

FIGS. 13A–13E illustrate several structural implementations for a color ink transfer device 52. However, it is important to note that the color ink transfer device 52 can have many different sizes and shapes. FIG. 13A illustrates a page-width linear array embodiment in which the device 52 can print the width of the printing media 10 in each of four colors. The page-width linear array includes a cyan chamber 1*a*, a magenta chamber 1*b*, a yellow chamber 1*c* and a black chamber 1*d*. Each chamber 1*a*–1*d* supplies colored ink to a distinct group of orifices 6 which correspond to the particular chamber. That is, the cyan chamber 1*a* supplies cyan colored ink to the orifices 6*a*, the magenta chamber 1*b* supplies magenta colored ink to the orifices 6b, the yellow chamber 1c supplies yellow colored ink to the orifices 6c, and the black chamber 1d supplies black ink to the orifices 6d. Thus, by combining the ink from the various chambers, full color printing is achieved.

Figure 13B:
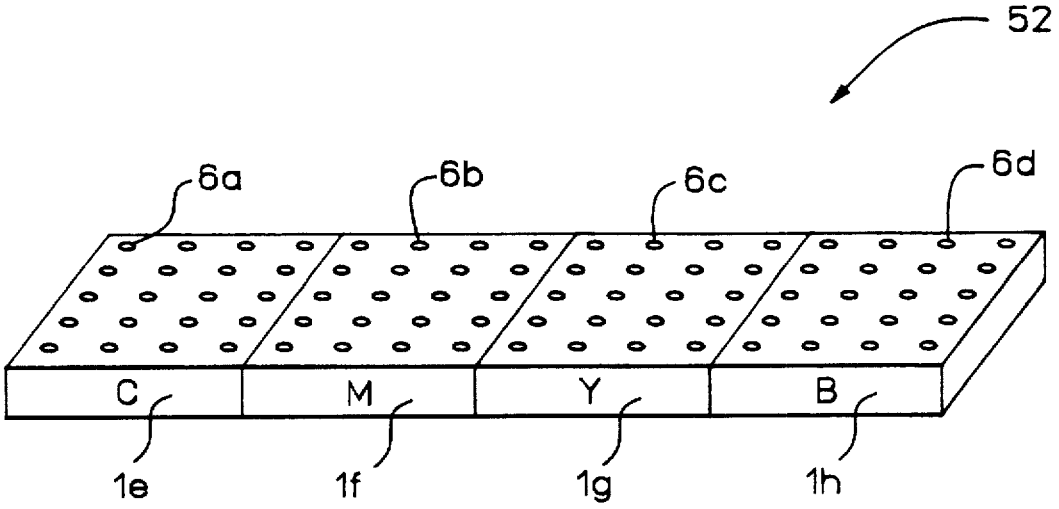
Figure 13C:
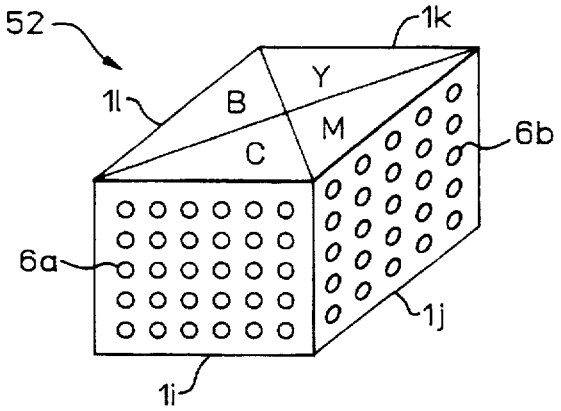
Figure 13D:
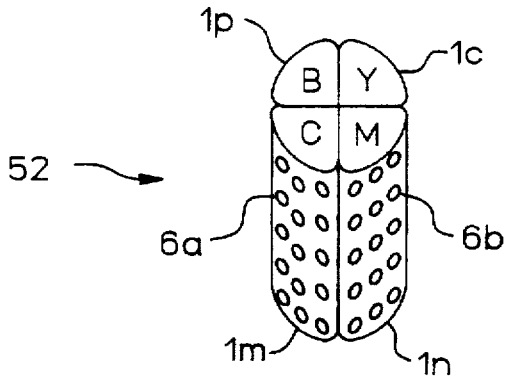
Figure 13E:
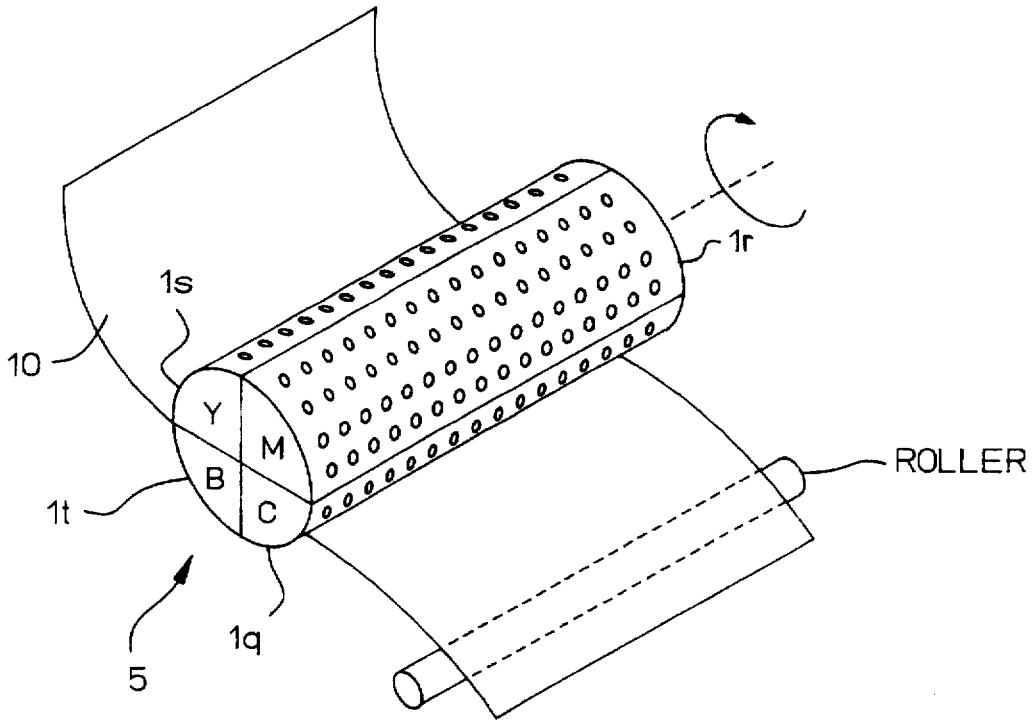

FIG. 13B illustrates a full-page array embodiment in which ink chambers 1e–1h enable the color ink transfer device 52 to print one page at a time in each of the three primary colors as well as black. In this embodiment, each of the ink chambers 1e–1h is slightly larger than a page to be printed. FIG. 13C illustrates a cubic array in which each side surface is an ink transfer device 1 with an ink chamber 1i–1l having a different colored ink. FIG. 13D illustrates a curved cubic array having colored ink chambers 1m–1p. FIG. 13E illustrates a cylinder array having colored ink chambers 1q–1t. The size and shape of the ink chambers 1a–1t is flexible, but dependent on the configuration of the color ink transfer device 52 desired.

Figure 14:
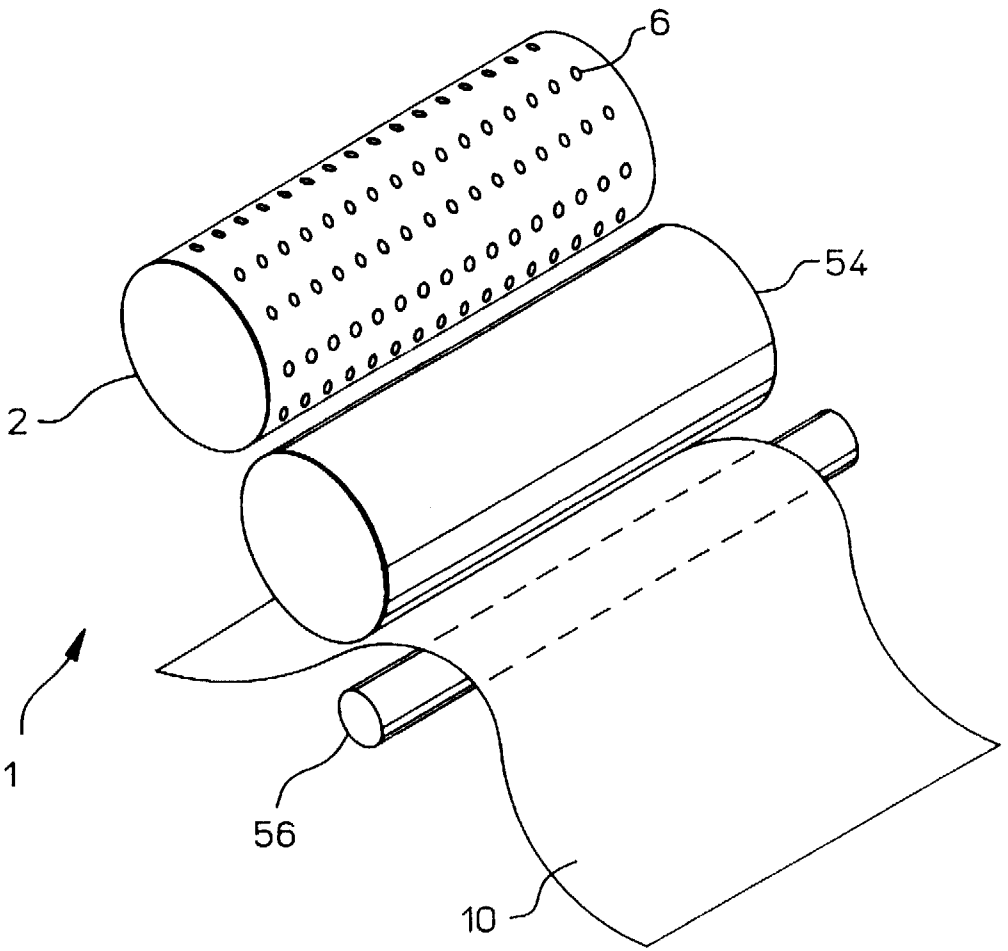
FIG. 14 is a three-dimensional diagram illustrating an ink transfer system which uses an intermediate transfer surface.

Yet another optional feature of the present invention is the use of an intermediate transfer surface. FIG. 14 illustrates an ink transfer device 1 which uses an intermediate transfer surface 54 to assist in transferring the ink from the surface of the ink reservoir 2 to the printing media 10. As discussed above, an advantage of the present invention is that a wide variety of printing media 10 may be used, including plain paper and transparencies. However, since the present invention is able to operate with a wide variety of printing media, the paper quality and absorptivity could vary significantly. As a result, it may be desirable to first transfer the ink on the outer surface of the ink reservoir 2 to the intermediate transfer surface 54.

For example, FIG. 14 shows a cylindrical-shape ink reservoir 2 contacting a cylindrical-shape intermediate transfer surface 54. The intermediate transfer surface 54 will have a known quality and absorptivity such that the ink will cleanly transfer to the intermediate transfer surface 54. That is, virtually none of the ink will remain on the outer surface of the ink reservoir 2. As an example, the outer surface of the intermediate transfer surface 54 can be made of a polymer material such as mylar or rubber. Further, the size of the intermediate transfer surface 54 need not be similar to that of the ink reservoir 2.

Once the ink is on the intermediate transfer surface 54, the ink can be transferred to the printing media 10 by contacting the printing media 10 with the intermediate transfer surface 54 using any of a number of techniques. FIG. 14 shows the ink being transferred to the printing media 10 using a roller 56 which presses the printing media 10 against the intermediate transfer surface 54. After the ink is transferred to the printing media 10, the intermediate transfer surface 54 is cleaned off to remove any residue ink which did not transfer. A rubber doctor blade (not shown) may be used to perform the cleaning off process.

Figure 16A:
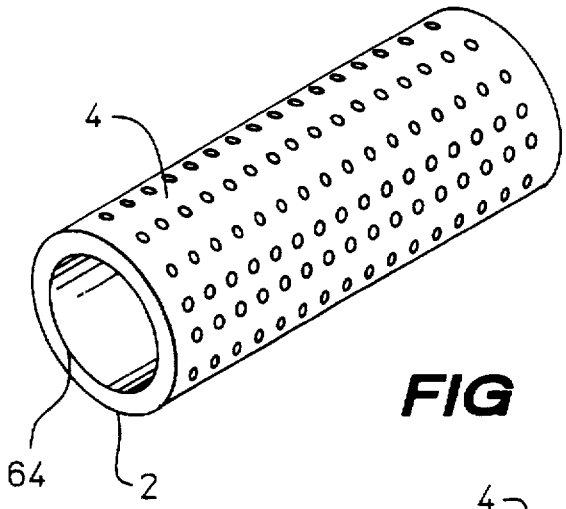
FIG. 16A is a three-dimensional diagram illustrating a cylindrical-shaped ink reservoir which includes an inner cylinder, a pressurized chamber and a piston to pressurize the ink.
Figure 16B:
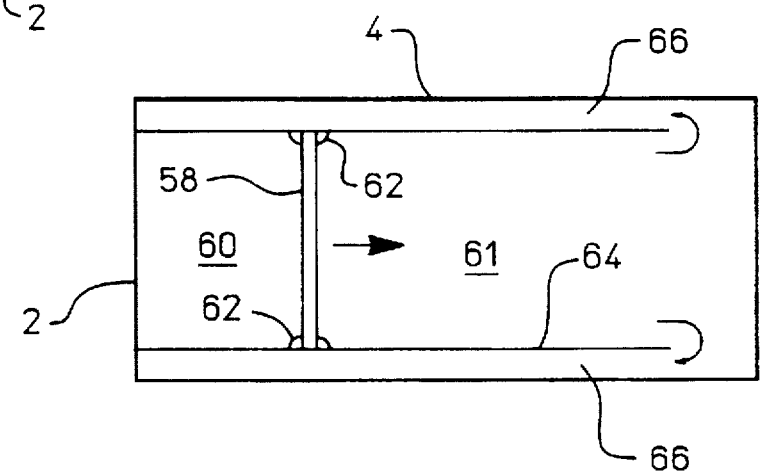
FIG. 16B is a cross-sectional diagram of the cylindrical-shaped ink reservoir illustrated in FIG. 16A.
Figure 15:
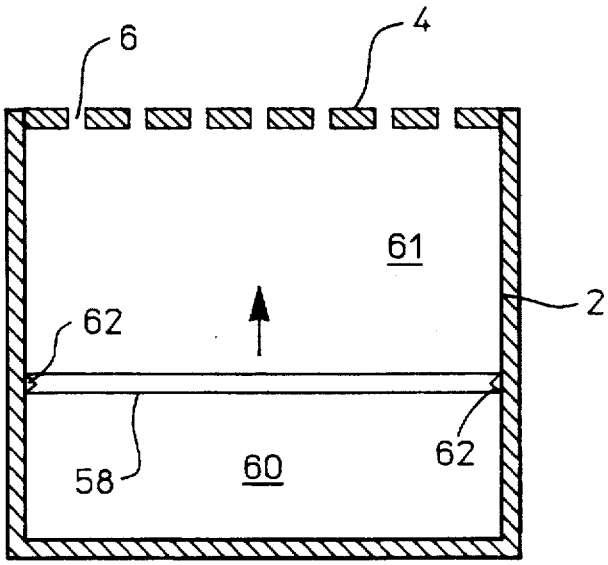
FIG. 15 is a cross-sectional diagram illustrating a rectangular ink reservoir which includes a pressurized chamber and a piston to pressurize the ink.

Still another optional feature of the present invention is perhaps a preferred way to pressurize the ink reservoir 2. According to this feature, the ink reservoir 2 is itself pressurized without any need for a pressure inlet 16 (see FIG. 4). FIGS. 15, 16A and 16B illustrate implementations of this feature. The ink reservoir 2 further includes a piston 58, a pressurized inner chamber 60 and an ink chamber 61, but no longer includes a pressure inlet 16. The piston 58 is fitted with an o-ring 62 so that the ink chamber 61 is isolated from the pressurized inner chamber 60. The pressure applied by the pressurized inner chamber 60 causes the piston 58 to move toward the ink transfer surface 4 as the ink flows out from the orifices 6 during printing.

FIG. 15 illustrates this feature in a rectangular ink reservoir, while FIGS. 16A and 16B illustrate this feature with respect to a cylindrical-shaped ink reservoir. With respect to the cylindrical-shaped ink reservoir, an inner cylinder 64 is also needed. In this case, the piston 58 and o-ring 62 contact the inner cylinder 64 as shown in FIG. 16B. The inner cylinder 64 is also shorter than the cylindrical-shaped ink reservoir 2. As ink flows from the orifices 6 during printing, the piston 58 will move so as to expand the pressurized chamber 60 and reduce the volume of the ink chamber 61. This piston movement pushes ink out of the ink chamber 61 and towards the orifices 6 via channels 66 (see FIG. 16B). Hence, the ink is pressurized using the pressurized chamber 60. Although the pressure applied to the ink will decrease as the quantity of ink within the ink chamber 61 decreases, the device can be constructed so that the pressure variation is within an acceptable range of operation.

The many features and advantages of the present invention are apparent from the detailed description and thus it is intended by the appended claims to cover all such features and advantages of the invention. Further, since numerous modification and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. An ink transfer printing device, comprising:

an ink reservoir for retaining ink, the ink having a positive pressure being applied thereto, said reservoir being associated with an ink transfer surface with a plurality of perforations, the ink being such that the viscosity of the ink under ambient conditions prevents the flow of the ink in the perforations;

viscosity control means for inducing a change in the viscosity of the ink near certain of the perforations thereby enabling a controlled amount of the ink near each of said certain of the perforations to flow through said certain of the perforations to an outer surface of said ink transfer surface, the viscosity control means causing the magnitude of change in viscosity of the ink to far exceed the magnitude of change in surface tension for the ink; and ink transfer means for transferring the ink which has flowed onto the outer surface of the printing media, the ink being transferred by contacting the outer surface of said ink transfer surface to the printing media or an intermediate surface to the transfer of ink which has flowed onto the outer surface to the printing media.

2. A device as recited in claim 1, wherein the positive pressure being applied is dependent on the viscosity of the ink at ambient conditions.

3. A device as recited in claim 1, wherein said ink reservoir and said ink transfer surface are integrally connected, and wherein said ink reservoir comprises an ink chamber for containing the ink and a pressurized chamber for pressurizing the ink within said ink chamber.

4. A device as recited in claim 3, wherein said ink reservoir further comprises a movable piston for separating said pressurized chamber from said ink chamber.

5. A device as recited in claim 1, wherein the outer surface of said ink transfer surface is planar or tubular.

6. A device as recited in claim 1, wherein said ink transfer means comprises an intermediate transfer surface for receiving the ink which has flowed to the outer surface of said ink transfer surface and transferring the ink received to the printing media.

7. A device as recited in claim 1, wherein said device further comprises a plurality of thermal barriers positioned between the perforations on an ink-supply side of said ink transfer surface.

8. A device as recited in claim 1, wherein said ink reservoir comprises a plurality of ink channels, each ink channel supplying ink to a group of the perforations.

9. A device as recited in claim 8, wherein the flow of the ink within said ink channels is perpendicular to the flow of the ink through the perforations.

10. A device as recited in claim 9, wherein the ink transfer surface has a circular shape, and wherein said ink reservoir comprises a common channel and a plurality of ink channels, each of said ink channels supplying ink to at least one of the perforations, said ink channels extend radially outward from said common channel which supplies the ink from said ink reservoir to said ink channels.

11. In an ink transfer printing device wherein ink is transferred from an ink reservoir to a printing media via a perforated surface, the perforated surface having a plurality of orifices, wherein the improvement comprises driving ink transfer by decreasing the magnitude of the viscosity of the ink in a manner that far exceeds the magnitude of decrease in surface tension of the ink near certain of the orifices thereby enabling a controlled amount of the ink near said certain of the orifices and remain about said certain orifices until transferred to the printing media by contacting the printing media with the perforated surface.

12. In an ink transfer printing device as recited in claim 11, wherein the viscosity of the ink at ambient conditions is at least 10 cps.

13. In an ink transfer printing device as recited in claim 11, wherein the ink consists essentially of (by weight) 2–10% colorant, 93–60% carriers(s), and 5–30% additives.

14. An ink transfer method for transferring ink from an ink reservoir to a printing media, the ink reservoir being associated with a contact surface having a plurality of perforations, said method comprising the steps of:

(a) applying a positive pressure to the ink;

(b) using the viscosity of the ink at ambient conditions to retain the ink within the reservoir, the ink at the ambient conditions, the magnitude of change in viscosity of the ink far exceeding the magnitude of change in surface tension for the ink;

(c) inducing a change in the viscosity of the ink near certain of the perforations thereby enabling a controlled amount of the ink to flow onto the contact surface via said certain of the perforations; and (d) transferring the ink which had flowed onto the contact surface, to the printing media by contacting the surface with the printing media or an intermediate transfer surface to transfer the ink which has flowed onto the contact surface to the printing media.

15. A method as recited in claim 14, wherein the ink reservoir and the contact surface are integrally connected, and the ink reservoir includes at least an ink chamber for containing the ink and a pressurized chamber for pressurizing the ink within the ink chamber, and wherein said applying step (a) comprises the steps of:

(a1) using the pressurized chamber to apply the positive pressure to the ink chamber; and (a2) enlarging the volume of the pressurized chamber and reducing the volume of the ink chamber as ink flows out of the ink reservoir.

16. A method as recited in claim 14, wherein step (d) comprises the steps of:

(d1) transferring the ink on the contact surface to the intermediate transfer surface by contacting the contact surface with the intermediate transfer surface; and (d2) transferring the ink from the intermediate transfer surface to the printing media by contacting the intermediate transfer surface to the printing media.

17. A method as recited in claim 14, wherein said inducing step (c) comprises the step of locally heating the ink near said certain of the perforations to reduce the viscosity of the ink near said certain of the perforations.

18. A method as recited in claim 17, wherein when step (c) reduces the viscosity of the ink, the pressure being applied in step (a) causes the heated ink near said certain of the perforations to flow onto the contact surface of the ink transfer surface via said certain of the perforations.

19. A method as recited in claim 14, wherein said inducing step (c) comprises the step of applying an electric field near each of said certain of the perforations to change the viscosity of the ink near said certain of the perforations.

20. A method as recited in claim 15, wherein said inducing step (c) comprises the step of applying a magnetic field near each of said certain of the perforations to change the viscosity of the ink near said certain of the perforations.

* * * * *